US012134806B2

(12) United States Patent
Yamamoto et al.

(10) Patent No.: US 12,134,806 B2
(45) Date of Patent: Nov. 5, 2024

(54) ALUMINUM ALLOY FOR DIE CASTING AND DIE CAST ALUMINUM ALLOY MATERIAL

(71) Applicants: NIPPON LIGHT METAL COMPANY, LTD., Tokyo (JP); NIKKEI MC ALUMINIUM CO., LTD., Tokyo (JP)

(72) Inventors: Izumi Yamamoto, Shizuoka (JP); Tomohiro Isobe, Aichi (JP); Hiroshi Horikawa, Tokyo (JP)

(73) Assignees: NIPPON LIGHT METAL COMPANY, LTD., Tokyo (JP); NIKKEI MC ALUMINIUM CO., LTD., Tokyo (JP)

( * ) Notice: Subject to any disclaimer, the term of this patent is extended or adjusted under 35 U.S.C. 154(b) by 649 days.

(21) Appl. No.: 17/289,436

(22) PCT Filed: Oct. 30, 2019

(86) PCT No.: PCT/JP2019/042496

§ 371 (c)(1),
(2) Date: Apr. 28, 2021

(87) PCT Pub. No.: WO2020/095777

PCT Pub. Date: May 14, 2020

(65) Prior Publication Data

US 2022/0002845 A1 Jan. 6, 2022

(30) Foreign Application Priority Data

Nov. 7, 2018 (JP) ..... 2018-209675

(51) Int. Cl.
*C22C 21/08* (2006.01)
*C22C 1/02* (2006.01)

(52) U.S. Cl.
CPC ..... *C22C 21/08* (2013.01); *C22C 1/026* (2013.01)

(58) Field of Classification Search
CPC ..... C22C 21/06; C22C 21/08; C22C 1/026; C22C 21/12; C22F 1/047; C22F 1/057
See application file for complete search history.

(56) References Cited

U.S. PATENT DOCUMENTS

2003/0111139 A1* 6/2003 Major ..... C22C 21/06 420/541
2012/0034128 A1* 2/2012 Yamaura ..... C22C 21/08 420/534
2017/0154700 A1* 6/2017 Yamamoto ..... C22C 21/06

FOREIGN PATENT DOCUMENTS

WO WO-9630554 A1 * 10/1996 ..... C22C 21/06

* cited by examiner

*Primary Examiner* — Jessee R Roe
(74) *Attorney, Agent, or Firm* — RANKIN, HILL & CLARK LLP

(57) ABSTRACT

The present invention provides a non-heat-treatable aluminum alloy for die casting, which can exhibit good castability and is able to confer excellent tensile characteristics (0.2% proof stress and elongation) and excellent corrosion resistance on die cast aluminum alloy materials. Also, the present invention provides a die cast aluminum alloy material having excellent tensile characteristics (0.2% proof stress and elongation) and excellent corrosion resistance. An aluminum alloy for die casting of the present invention comprises Mg: 3.7 to 9.0% by mass and Mn: 0.8 to 1.7% by mass, with the balance being Al and unavoidable impurities. It is preferable that the Mn content is 0.9 to 1.7% by mass and the Mg content is 4.7 to 9.0% by mass.

7 Claims, 2 Drawing Sheets

[FIG. 1]
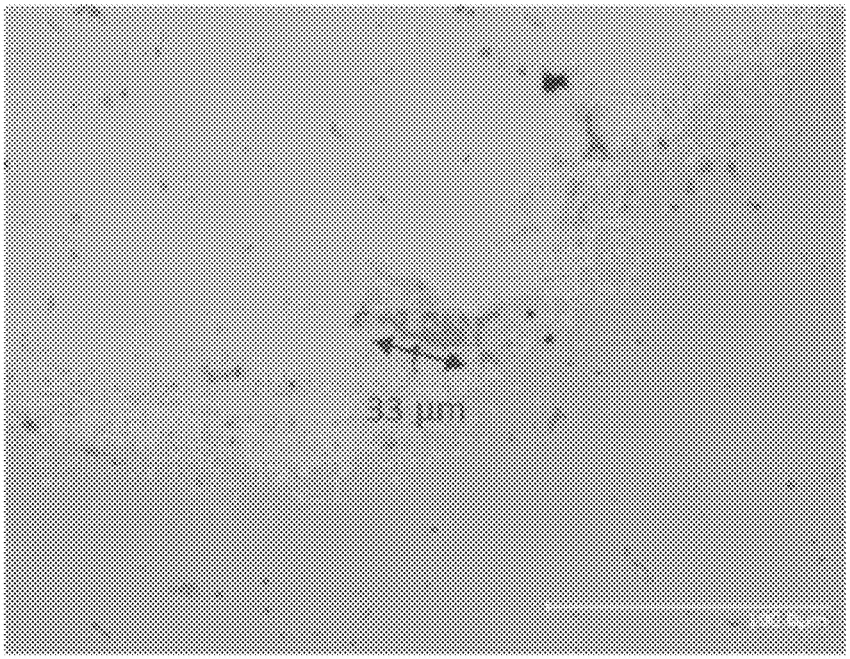
[FIG. 2]
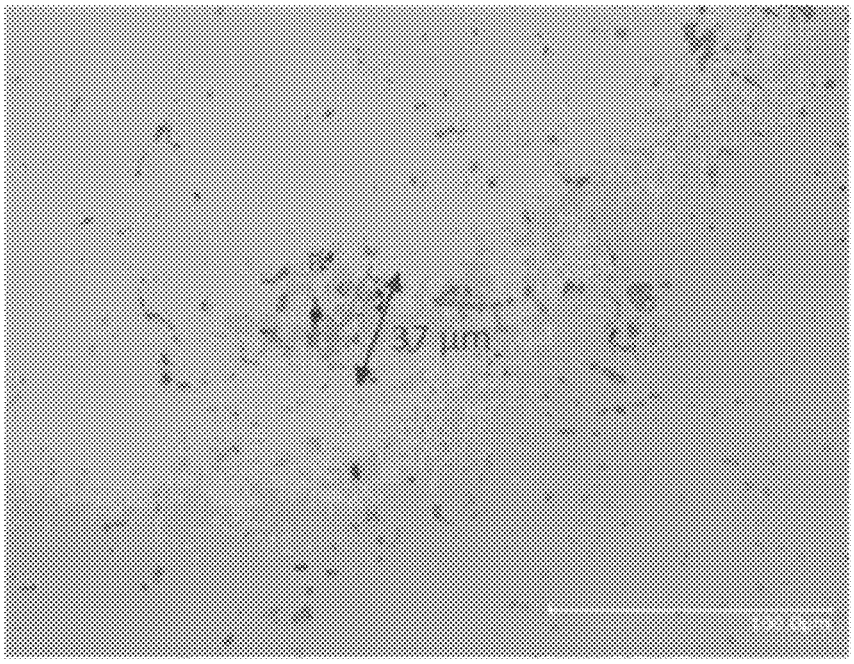

[FIG. 3]
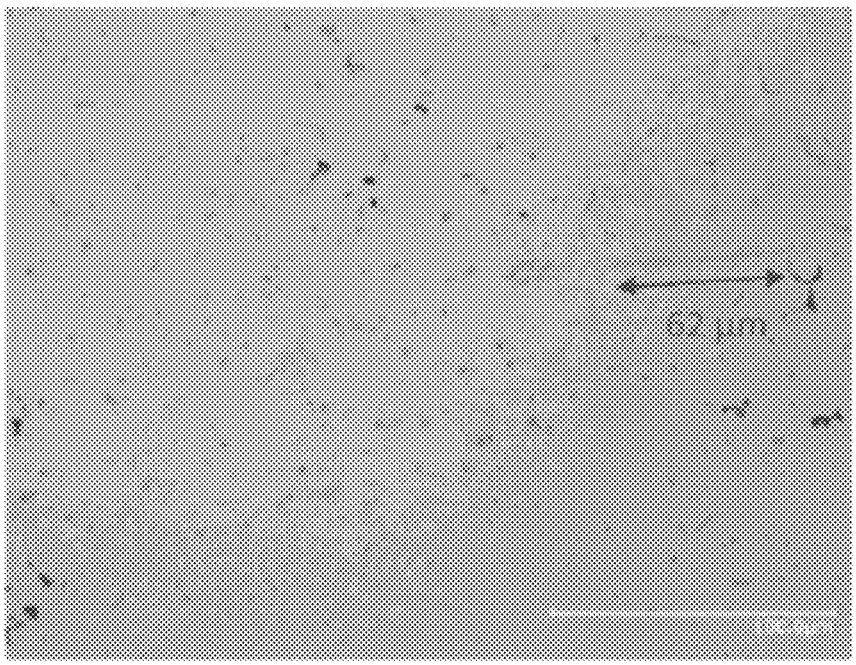
[FIG. 4]
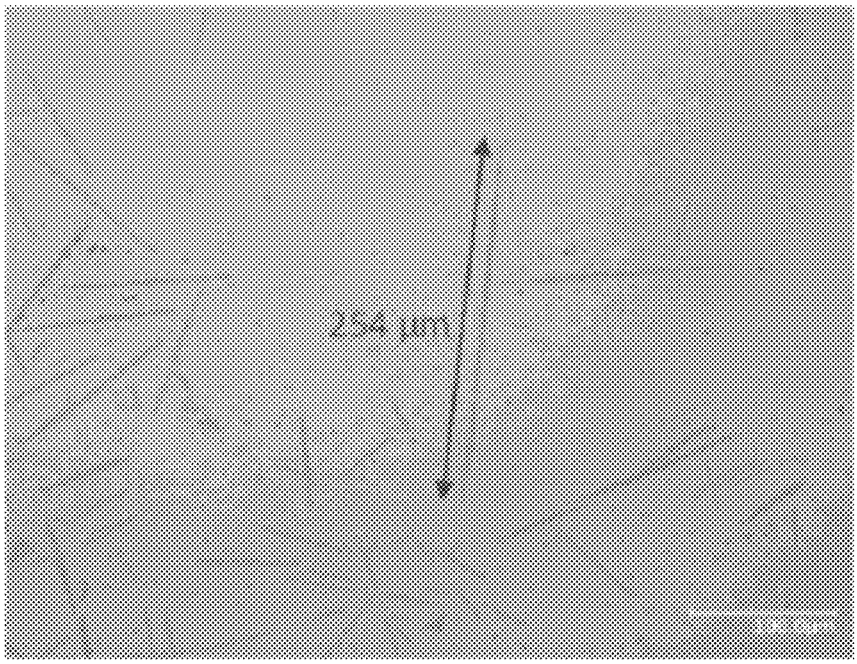

ALUMINUM ALLOY FOR DIE CASTING AND DIE CAST ALUMINUM ALLOY MATERIAL

TECHNICAL FIELD

The present invention relates to a non-heat-treatable type highly tough aluminum alloy for die casting.

PRIOR ARTS

In vehicles such as automobiles, since efforts have being made to reduce the weight of vehicles with the aim of improving fuel efficiency and reducing the environmental burden, as a material for vehicle members, attention has been paid to aluminum alloy, which is lighter than iron. Though there are various methods for manufacturing vehicle members using aluminum alloys, a die casting method can be mentioned as a method suitable for mass production of the members at low cost.

When producing a member with a complicated shape, as compared with the method of forming the member by applying plastic working to the wrought material, the die casting method is advantageous in terms of cost, because the member formed by the die casting method has a shape closer to the final shape at the time of casting, and thus the number of post-processing steps is reduced. However, in order to obtain the mechanical properties required for vehicle members in die casting materials, heat treatment is often required for the cast products. Heat treatment includes the solution treatment where the material is heated at a high temperature for a long time and the aging treatment where the material is heated and held at a relatively low temperature, but there are many additional factors for increasing the cost for both treatments, because the processes involve long time of work, and incur non-negligible fuel costs in the heating process, and in addition, even after the heat treatment, it is necessary to correct the strain of the member generated due to overheating and cooling. In view of these, it cannot be said that the cost reduction effect by using the die casting method in the manufacturing of the members can be sufficiently exhibited. Therefore, a non-heat-treatable type alloy that does not require heat treatment after casting is regarded as important in that the manufacturing cost can be further reduced.

Considering these backgrounds, when selecting a material for vehicle members, there is a trade-off relationship between the mechanical properties required for the target member and the manufacturing cost. In such a situation, in the non-heat-treatable type aluminum alloy for die casting, it has been desired to realize the bringing out of high mechanical properties, particularly strength and toughness required for vehicle members, which leads to expansion of the applicable range of the non-heat-treatable type alloy and has the effect of reducing the vehicle manufacturing cost.

Here, as the non-heat-treatable type aluminum alloy for die casting, there are Al—Si—Mg—Fe-based alloys, Al—Si—Cu—Mg-based alloys, Al—Mg—Mn-based alloys, and the like, and among them, in particular, Al—Mg—Mn-based alloys exhibit remarkably high toughness.

For example, in Patent Literature 1 (U.S. Pat. No. 1,866,145), there is disclosed an aluminum alloy for corrosion-resistant die casting, which is characterized by containing Mn: 2.04% to 3.0% and Mg: 5.0% to 8.0% in weight % concentration, with the balance being Al and unavoidable impurities. In this invention, by utilizing the formation of the intermetallic compound $Al_6Mn$ in the alloy, when adding Mn having a high concentration of around 2% in weight % concentration, the strength can be improved without impairing the corrosion resistance.

Further, in Patent Literature 2 (JP H11-293375 A), there is disclosed an alloy composition in the aluminum alloy for die casting, which is characterized by containing Mg: 2.5 to 7%, Mn: 0.2 to 1.0%, Ti: 0.05 to 0.2%, in a mass % concentration, with the balance being Al and unavoidable impurities, and especially for Fe and Si, Fe: less than 0.3% and Si: 0.5% or less. In this invention, it is said that, considering the fact that the Al—Mg-based compound in the alloy improves the toughness, while the Mg—Si-based compound and the Al—Si—Fe-based compound adversely affect the toughness, a composition that brings high toughness to the alloy can be obtained by adding Mg at a high concentration and restricting Fe and Si to low concentrations.

Further, in Patent Literature 3 (JP 11-80875 A), there is disclosed an aluminum alloy which contains, in a weight % concentration, Mg: 2.5 to 6.5%, Mn 0.5 to 1.4%, Si less than 0.5%, less than 0.5% Fe, less than 0.15% Ti with the balance of aluminum and unavoidable impurities. In this invention, it is said that by employing the alloy composition, it is possible to provide weldability, strength and elongation, and resistance to corrosion and stress corrosion, which are suitable for the vehicle frame member.

CITATION LIST

Patent Literature

Patent Literature 1: Japanese Patent No. 1866145
Patent Literature 2: JP H11-293375 A
Patent Literature 3: JP H11-80875 A

SUMMARY OF INVENTION

Technical Problem

Originally, aluminum alloys used for structural members were required to be high-strength and high-toughness materials, but in recent years, from the view point that the momentum for weight reduction of vehicles has been increasing, it has been difficult to meet the demand for improved strength and toughness when employing conventional alloys used as aluminum alloys for die casting.

In each samples of Sample Nos. 1 to 7 in the examples of Patent Literature 1 mentioned above, Mg and Mn were added at relatively high concentrations, and due to this, the proof stress showed relatively high values in many samples, while the elongation remained at around 10%. Further, in the composition disclosed as Example 2 of Patent Literature 2, although Mn has a low concentration and has a relatively good elongation, the proof stress required for the vehicle members cannot be obtained. In other examples, there is no example having sufficient proof stress and elongation, and variations are observed as to the elongation in the casting qualities, due to the low content of Mn which is effective in improving castability. Further, with respect to the composition disclosed in the examples of Patent Literature 3, there is no example in which both the proof stress and elongation required for the aluminum alloy for vehicle members in recent years are satisfied.

On the other hand, as the applying region of aluminum alloys to vehicle members has expanded, since the use of aluminum alloys for parts where the corrosion resistance and the beauty of the surface are as important as the strength, such as parts that are exposed to the outside or parts that can be noticed by consumers even if they do not appear directly to the outside, is increasing, the development of alloys with excellent corrosion resistance and brilliance is also required at the same time. However, in the aluminum alloys of Patent Literatures 1 to 3, these characteristics are not fully considered.

Considering the above problems in the prior arts, an object of the present invention is to provide a non-heat-treatable aluminum alloy for die casting, the aluminum alloy exhibiting good castability and being able to confer excellent tensile characteristics (0.2% proof stress and elongation) and excellent corrosion resistance on die cast aluminum alloy materials. Also another object of the present invention is to provide a die cast aluminum alloy material having excellent tensile characteristics (0.2% proof stress and elongation) and excellent corrosion resistance. Hereinafter, 0.2% proof stress may be simply referred to as proof stress.

Solution to Problem

As a result of intensive studies on aluminum alloys for die casting and die cast aluminum alloy materials in order to achieve the above object, the present inventors have found that strictly controlling of the addition amounts of Mg and Mn in the Al—Mg—Mn-based alloys is extremely effective, and have arrived at the present invention.

Namely, the present invention can provide an aluminum alloy for die casting, containing Mg: 3.7 to 9.0% by mass and Mn: 0.8 to 1.7% by mass, with the balance being Al and unavoidable impurities.

In the aluminum alloy for die casting of the present invention, the strength of the aluminum alloy is improved by adding Mg and Mn. Further, by adding an appropriate amount of Mn, seizure of the molten metal on the mold is suppressed. On the other hand, by defining the upper limit of the addition amount of Mg, it is possible to suppress the decrease in castability (die casting) and ductility, and by defining the upper limit of the addition amount of Mn, it is possible to suppress the formation of coarse crystals of the Al—Mn-based compound which causes the decrease in ductility.

Here, the natural electrode potential of the Al—Mn compound is the same as that of Al (matrix), and the addition of Mn does not reduce the corrosion resistance of the die cast aluminum alloy. Further, it is known that the Al—Mg-based compound has good corrosion resistance, and the influence of the addition of Mg on the corrosion resistance of the aluminum alloy for die casting is small, and good corrosion resistance can be maintained.

In addition, though the pure Al is the most excellent in terms of brilliance, since the area ratio of the Al—Mn compound almost does not increase until the addition amount of Mn is about 2.0% by mass, it is possible to suppress the effect on brilliance at a minimum level. In addition, it is known that the Al—Mg-based compound has good brilliance, and thus there is little adverse effect on the brilliance of the aluminum alloy for die casting.

In the aluminum alloy for die casting of the present invention, the Mn content is preferably 0.9 to 1.7% by mass, more preferably 1.2 to 1.7% by mass. Further, the upper limit of the Mn content is preferably 1.65% by mass, more preferably 1.60% by mass. Further, the Mg content is preferably 4.7 to 9.0% by mass, more preferably 5.2 to 6.5% by mass, and most preferable 5.5 to 6.0% by mass. By setting the contents of Mn and Mg in these ranges, the above-mentioned effects can be obtained more reliably.

Further, in the aluminum alloy for die casting of the present invention, it is preferable that the content of Si among the unavoidable impurities is regulated to 0.3% by mass or less. By setting the Si content to 0.3% by mass or less, the formation of a fragile $Mg_2Si$ compound that causes a decrease in toughness can be suppressed.

Further, in the aluminum alloy for die casting of the present invention, it is preferable that the Fe content of the unavoidable impurities is regulated to 0.4% by mass or less. By setting the Fe content to 0.4% by mass or less, the formation of a fragile Al—Mn—Fe-based compound that causes a decrease in toughness can be suppressed.

Further, the aluminum alloy for die casting of the present invention preferably further contains Ti: 0.001 to 1.0% by mass and/or B: 0.0001 to 0.1% by mass as optional additive elements. By adding Ti and B, the structure is refined and the toughness of the aluminum alloy can be improved. On the other hand, in order to suppress the formation of coarse crystals that decrease toughness, the upper limits of the addition amounts are defined.

Further, the present invention can also provide a die cast aluminum alloy material made of aluminum alloy for die casting of the present invention, which has a tensile property of 0.2% proof stress of 140 MPa or more and elongation of 11% or more.

Since the die cast aluminum alloy material of the present invention is a die casting material made of the aluminum alloy for die casting of the present invention, both proof stress and elongation are compatible at a high level. Here, the 0.2% proof stress is preferably 150 MPa or more, and more preferably 160 MPa or more. Further, the elongation is preferably 12% or more, more preferably 15% or more, and most preferably 20% or more.

Further, in the aluminum alloy die casting material of the present invention, it is preferable that the maximum particle size of the primary crystal Al—Mn-based compound in the longitudinal direction is 150 μm or less. Since the maximum particle size of the primary crystal Al—Mn-based compound in the longitudinal direction is 150 μm or less, excellent ductility and corrosion resistance are realized. Here, the maximum particle size of the primary crystal Al—Mn-based compound in the longitudinal direction is preferably 100 μm or less, and more preferably 50 μm or less.

Effects of the Invention

According to the present invention, it is possible to provide a non-heat-treatable aluminum alloy for die casting, the aluminum alloy exhibiting good castability and being able to confer excellent tensile characteristics (0.2% proof stress and elongation) and excellent corrosion resistance on die cast aluminum alloy materials. Also according to the present invention, it is possible to provide a die cast aluminum alloy material having excellent tensile characteristics (0.2% proof stress and elongation) and excellent corrosion resistance.

BRIEF DESCRIPTION OF THE DRAWINGS

FIG. 1 shows an optical micrograph of the cross section of the test piece obtained in Example 1.

FIG. 2 shows an optical micrograph of the cross section of the test piece obtained in Example 2.

FIG. 3 shows an optical micrograph of the cross section of the test piece obtained in Comparative Example 1.

FIG. 4 shows an optical micrograph of the cross section of the test piece obtained in Comparative Example 2.

EMBODIMENTS FOR ACHIEVING THE INVENTION

In the following, typical embodiments of the aluminum alloy for die casting and the die cast aluminum alloy material according to the present invention will be described in detail, but the present invention is not limited to these.

1. Aluminum Alloy for Die Casting

The aluminum alloy for die casting of the present invention is composed of the aluminum alloy for die casting which contains Mg: 3.7 to 9.0% by mass and Mn: 0.8 to 1.7% by mass, with the balance being Al and unavoidable impurities. In the following, each component will be described in detail.

Mg: 3.7 to 9.0% by Mass

Mg has the effect of improving the proof stress by mainly solid-solved in the matrix of the alloy. However, when added in a high concentration, the viscosity of the molten metal becomes high, and the oxide film formed on the surface of the molten metal during casting inhibits the flow of the molten metal, which makes high quality casting difficult. In order to prevent the decrease in elongation due to this reason, it is necessary to set the upper limit of the Mg content to 9.0% by mass. On the other hand, when the Mg content is low, the proof stress targeted in the present invention cannot be satisfied, so the lower limit is set to 3.7% by mass. In order to achieve both strength and elongation at a higher level, the Mg content is preferably 4.7 to 9.0% by mass, more preferably 5.2 to 6.5% by mass, most preferably 5.5 to 6.0% by mass.

Mn: 0.8 to 1.7% by Mass

Mn has the effect of improving proof stress by mainly being dissolved in the matrix. Although the effect of the solid solution of Mn on the toughness is small, when the addition amount increases and coarse crystals of the Al—Mn-based compound appear, the coarse crystal becomes the starting point of fracture and the decrease in elongation is observed. Therefore, it is necessary to set the upper limit of the Mn content to 1.7% by mass. Further, Mn has an advantageous effect on castability, such as improving the seizure of the molten metal into the mold during die casting. Therefore, when the Mn content is less than 0.8% by mass, seizure cannot be completely prevented and mold release after casting becomes difficult, and thus it is necessary to set the lower limit of the content to 0.8% by mass. The preferable Mn content for achieving both castability and elongation is 0.9 to 1.7% by mass, and the more preferable content is 1.2 to 1.7% by mass. In addition, the addition amount of Mn is 1.7% by mass or less from the viewpoint of imparting excellent brilliance to the die cast aluminum alloy. Further, the upper limit of the Mn content is preferably 1.65% by mass, more preferably 1.60% by mass.

Si: 0.3% by Mass or Less

In the composition of the aluminum alloy for die casting of the present invention, when Si is added, a fragile $Mg_2Si$ compound is formed and the toughness is decreased. Therefore, among the unavoidable impurities, the Si content is preferably regulated to 0.3% by mass or less, and more preferably 0.2% by mass or less.

Fe: 0.4% by Mass or Less

In the composition of the aluminum alloy for die casting of the present invention, when Fe is added, a fragile Al—Mn—Fe-based compound is formed and the toughness is decreased. Therefore, among the unavoidable impurities, the Fe content is preferably regulated to 0.4% by mass or less, and more preferably 0.3% by mass or less. In addition, since the addition of Fe decreases the corrosion resistance of the aluminum alloy for die casting, the addition amount is regulated to 0.4% by mass or less from this viewpoint as well.

Ti: 0.001 to 1.0% by Mass

Ti is preferably added as an optional additive element in an amount of 0.001 to 1.0% by mass. Ti improves the toughness of the aluminum alloy by refining the structure, and also has the effect of preventing casting cracks due to the refining. When being less than 0.001% by mass, the effect is small, and when containing in excess of 1.0% by mass, coarse crystals of Al—Ti-based compounds are formed, which adversely affects the toughness, and thus the addition amount is limited within the above range.

B: 0.0001 to 0.1% by Mass

B is preferably added as an optional additive element in an amount of 0.0001 to 0.1% by mass. B improves the toughness of the aluminum alloy by refining the structure, and also has the effect of preventing casting cracks due to the refining. When being less than 0.0001% by mass, the effect is small, and when containing in excess of 0.1% by mass, the effect is not improved, and thus the addition amount is limited within the above range.

Be: 0.001 to 0.1% by Mass

Be is effective for preventing the depletion of Mg and can be used as an optional additive element. In case of adding Be, the effect of preventing Mg depletion is not sufficient when being less than 0.001% by mass, and even if added in excess of 0.1% by mass, the effect of preventing Mg depletion has already been sufficiently obtained, and thus it becomes a factor of cost increase.

Examples of elements other than the above elements that can be additionally added include Cr, Zn, V, Ni, Zr, Sr, Cu, Mo, Sc, Y, Ca, and Ba. When these are contained in an amount of Cr: 0.5% by mass or less, Zn: 1.0% by mass or less, V: 0.5% by mass or less, Ni: 0.5% by mass or less, Zr: 0.5% by mass or less, Sr: 0.5% by mass or less, Cu: 0.5% by mass or less, Mo: 0.5% by mass or less, Sc: 0.5% by mass or less, Y: 0.5% by mass or less, Ca: 0.5% by mass, and Ba: 0.5% by mass or less, the influence on toughness or corrosion resistance is small, and therefore addition is permitted.

Cr, Zn, V, Cu, Mo, Sc and Y are expected to have the effect of improving the strength of the aluminum alloy by being mainly dissolved in the matrix of the aluminum alloy, Ni is expected to have the effect of improving castability such as the effect of preventing the molten metal from seizing into the mold, Zr and Sr are expected to have the effect of improving toughness and casting crack resistance caused by refining the structure, and Ca and Ba are expected to have the effect of preventing oxidative depletion of elements in the molten metal.

2. Method for Preparing Aluminum Alloy for Die Casting

In the following, the method for preparing the aluminum alloy for die casting of the present invention having the above composition will be described in detail.

(1) Melting of Molten Aluminum Alloy

In the preparation process of the aluminum alloy, the molten alloy of high temperature causes oxidative depletion of elements. The degree of oxidative progress differs depending on the contained element, and the more reactive the element, the faster the oxidative depletion progresses. Here, Mg contained in the components of the aluminum alloy of the present invention is a highly reactive element, and when the molten metal containing Mg is overheated, a magnesium oxide is formed on the surface of the molten metal, and the Mg concentration in the molten metal decreases. It is possible to add extra Mg in anticipation of wear, but it is difficult to adjust the concentration due to the ever-decreasing Mg content, and it requires additional cost for adding extra Mg, which results in many unfavorable points in operation. It is known that this oxidative depletion of Mg is improved by adding Be of 10 ppm or more, and it is preferable to add from the view point of operation.

It is preferable that the element having the effect of preventing oxidative depletion is added to the molten metal before Mg is added when adjusting the components of the molten metal. This is because if Mg is added first, the Mg is depleted not a little in the time from the addition of Mg to the addition of the element having the effect of preventing oxidative depletion.

(2) Pre-Casting Treatment

Impurities such as hydrogen gas and oxides are mixed in the molten metal that is melted in the atmosphere, and when this molten metal is cast as it is, defects such as porosity are appeared during solidification, which results in inhibiting the toughness of the produced member. In order to prevent these defects, it is effective to perform bubbling with an inert gas such as nitrogen or argon gas after melting the molten metal and before die casting. The inert gas supplied from the lower part of the molten metal, when ascending, has the function of catching hydrogen gas and impurities in the molten metal and removing them to the surface of the molten metal.

3. Die Cast Aluminum Alloy Material

The die cast aluminum alloy material of the present invention is a die cast aluminum alloy material made of the aluminum alloy for die casting of the present invention having a tensile property of 0.2% proof stress of 140 MPa or more and elongation of 11% or more.

Both excellent 0.2% proof stress and elongation are basically realized by seriously optimizing the composition, and the desired tensile properties are obtained regardless of the shape and size of the die cast aluminum alloy material. Here, the 0.2% proof stress is preferably 150 MPa or more, and more preferably 160 MPa or more. The elongation is preferably 12% or more, more preferably 15% or more, and most preferably 20% or more.

The die cast aluminum alloy material of the present invention preferably has the maximum particle size of the primary crystal Al—Mn-based compound in the longitudinal direction is 150 μm or less. When the maximum particle size of the primary crystal Al—Mn-based compound in the longitudinal direction is 150 μm or less, excellent ductility and corrosion resistance are realized. Here, the maximum particle size of the primary crystal Al—Mn-based compound in the longitudinal direction is preferably 100 μm or less, and more preferably 50 μm or less.

The method for determining the size of the primary crystal Al—Mn-based compound is not particularly limited, and the measurement may be performed by various conventionally known methods. For example, the size can be obtained by cutting the die cast aluminum alloy material, observing the obtained cross-sectional sample with an optical microscope or a scanning electron microscope, and calculating the size of the primary crystal Al—Mn-based compound. At that time, the size of the primary crystal Al—Mn-based compound is measured so as to be large, and for example, when the aspect ratio of the primary crystal Al—Mn-based compound is large, the size in the longitudinal direction is measured. Depending on the observation method, the cross-sectional sample may be subjected to mechanical polishing, buffing, electrolytic polishing, etching or the like.

The shape and size of the die casting material are not particularly limited as long as the effects of the present invention are not impaired, and they can be used as various conventionally known members. Examples of the member include a vehicle body structural member such as a frame member.

4. Method for Manufacturing Die Cast Aluminum Alloy Material

The die cast aluminum alloy material of the present invention is a die casting material made of the aluminum alloy for die casting of the present invention, and has the above composition. In the following, the method for producing the aluminum alloy for die casting of the present invention will be described in detail.

Since the composition of the aluminum alloy for die casting of the present invention contains the element for the purpose of solid solution strengthening, it is necessary to pay attention to the cooling rate in the production of the die casting material. When the cooling rate at the time of casting is slow, Mg and Mn cannot be sufficiently solid-solved in the matrix, and therefore, it is preferable to secure a cooling rate of 50° C./sec or more at the time of casting. At this time, the casting pressure may be set from 50 MPa to 150 MPa.

Further, in the manufacturing of a member using the die casting method, since the molten metal is poured into the mold at high pressure and high speed, there is a case that air in the mold is involved in the molten metal, or a case that due to solidification shrinkage, defects such as bubbles, and nests are occur in the member. Since the presence of many such defects adversely affects the toughness of the member, it is preferable to take technical measures to reduce these defects during casting.

For example, a vacuum die casting method where air is prevented from being entrained in the molten metal by drawing air in the mold cavity before casting to create a vacuum state, a pore free die casting method (PF: Pore Free method, PF die casting method) where, after replacement the air in the mold cavity with active gas, for example, oxygen gas, and then the molten metal is poured, or the like is effective. According to the vacuum die casting method, the casting defects can be alleviated because the amount of air existing in the cavity is small in the first place, and according to the pore free die casting method, since the active gas, for example, oxygen, filled in the cavity reacts with the molten aluminum to form a fine oxide film ($Al_2O_3$) and is dispersed in the member, it is possible to suppress an adverse effect on the member characteristics.

There is a case where the alloy-based alloy, that is, the Al—Mg—Mn-based alloy to which the aluminum alloy for die casting of the present invention belongs, has a problem of inferior hot water flowability, because the alloy is different from the Al—Si-based alloy that is conventionally used widely as an alloy for die casting, and Si which is effective in improving castability is not actively added (or its content is regulated).

However, in the vacuum die casting method, since the inside of the mold cavity is negative pressure at the time of pouring, the mold filling property of the molten metal is promoted, and in the case of the pore free die casting method, since the active gas filled inside reacts with the molten aluminum alloy to create a negative pressure inside the cavity as in the vacuum die casting method to improve the mold filling property of the molten metal, and as a result, the same kind of effect as the improving the flowability of the alloy can be given. Therefore, in the Al—Mg—Mn-based alloy which is conventionally considered difficult to cast with good quality according to the die casting method, and in the prior literature, improvement was attempted by adding a high concentration of Mn or the like, it is possible to cast with good quality even at the Mn concentration of the composition of the aluminum alloy for die casting according to the present invention, and further, the effect of improving the elongation by lowering the Mn concentration can be exhibited.

Further, the aluminum alloy for die casting of the present invention is a non-heat treatable type aluminum alloy, and does not require heat treatment on the product after casting in order to obtain the mechanical properties required for the vehicle members in the die casting material. As a result, it is possible to reduce the cost related to the heat treatment step and the correction of the strain generated by the heat treatment step.

Although the typical embodiments of the present invention have been described above, the present invention is not limited to these, and various design changes are possible, and all of these design changes are included in the technical scope of the present invention.

EXAMPLES

Example 1

A Lansley test piece was produced by preparing the melting material so as to have the components (prepared values) described as Example 1 in TABLE 1. Here, the melting temperature and the casting temperature were set to "liquidus line temperature+100° C.", and the Lansley mold temperature was set to "150 f 50° C.". The composition of the obtained Lansley test piece was measured by emission spectroscopic analysis, and the obtained results (measured values) are shown in TABLE 1 together. The values in TABLE 1 are % by mass.

TABLE 1

| | | Cu | Si | Mg | Zn | Fe | Mn | Cr | Ti | P | Be | Al |
|---|---|---|---|---|---|---|---|---|---|---|---|---|
| Ex. 1 | Prepared Value | — | — | 5.7 | — | — | 1.0 | — | — | — | 0.0025 | Bal. |
| | Measured Value | 0.00 | 0.07 | 5.7 | 0.00 | 0.12 | 1.0 | <0.0002 | 0.00 | 0.0022 | 0.0027 | Bal. |
| Ex. 2 | Prepared Value | — | — | 5.7 | — | — | 1.3 | — | — | — | 0.0025 | Bal. |
| | Measured Value | 0.00 | 0.07 | 5.8 | 0.00 | 0.12 | 1.4 | <0.0002 | 0.00 | 0.0029 | 0.0025 | Bal. |
| Com. | Prepared Value | — | — | 5.7 | — | — | 1.95 | — | — | — | 0.0025 | Bal. |
| Ex. 1 | Measured Value | 0.00 | 0.07 | 5.8 | 0.00 | 0.12 | 1.95 | <0.0002 | 0.00 | 0.0025 | 0.0030 | Bal. |
| Com. | Prepared Value | — | — | 5.7 | — | — | 2.7 | — | — | — | 0.0025 | Bal. |
| Ex. 2 | Measured Value | 0.00 | 0.07 | 5.9 | 0.01 | 0.11 | 2.6 | <0.0002 | 0.00 | 0.0054 | 0.0026 | Bal. |

When the cross section of the Lansley test piece was mirror-polished and the size of the primary crystal Al—Mn-based compound was measured by observation with an optical microscope, the maximum size was 33 μm. An optical micrograph is shown in FIG. 1.

The Lansley test piece was processed into the shape of a JIS standard CT71 type tensile test piece, and a tensile test was conducted in a room temperature environment. The obtained results are shown in TABLE 2. Tensile tests have been carried out a total of three times, and one test piece has a 0.2% proof stress of 136 MPa, but the other pieces have a 0.2% proof stress of 140 MPa or more, and an elongation of 11% or more (The average value of 0.2% proof stress is 140 MPa).

TABLE 2

| | Tensile strength (MPa) | 0.2% Proof Stress (MPa) | Elongation (%) |
|---|---|---|---|
| Ex. 1 | 296 | 136 | 20 |
| | 301 | 140 | 24 |
| | 311 | 143 | 30 |
| Ex. 2 | 304 | 147 | 18 |
| | 322 | 152 | 23 |
| | 302 | 147 | 29 |
| Com. Ex. 1 | 322 | 173 | 13 |
| | 268 | 165 | 7 |
| | 277 | 169 | — |
| Com. Ex. 2 | 215 | 168 | 2 |
| | 188 | 168 | 2 |
| | 206 | 172 | 2 |

Example 2

A Lansley test piece was obtained in the same manner as in Example 1 except that the melting material was adjusted so as to have the components described as Example 2 in TABLE 1. The composition of the Lansley test piece was measured in the same manner as in Example 1, and the obtained results are shown in TABLE 1.

Further, when the size of the primary crystal Al—Mn-based compound was measured in the same manner as in Example 1, the maximum size was 37 μm. An optical micrograph is shown in FIG. 2.

Furthermore, the tensile test was performed in the same manner as in Example 1, and the obtained results are shown in TABLE 2. All test pieces have a 0.2% proof stress of 140 MPa or more and an elongation of 11% or more.

Example 3

After melting the aluminum alloy having the composition shown in TABLE 3, a die cast aluminum alloy material was obtained by die casting. The values in TABLE 3 are % by mass, which are the measurement results of the emission spectroscopic analysis.

TABLE 3

| | Cu | Si | Mg | Zn | Fe | Mn | Cr | Ti | P | Be | Al |
|---|---|---|---|---|---|---|---|---|---|---|---|
| Ex. 3 | <0.01 | 0.04 | 5.83 | <0.01 | 0.06 | 1.5 | — | — | — | 0.0026 | Bal. |

As a die casting method, a pore free die casting method was employed to produce a die casting material. The size of the mold used at this time was 110 mm×110 mm×3 mm, the casting pressure at the time of die casting was 120 MPa, the molten metal temperature was 730° C., and the mold temperature was 170° C. A water-soluble release agent was used.

When the No. 14B test piece specified in JIS-Z2241 was sampled from the obtained die cast aluminum alloy material and subjected to the tensile test at room temperature, the 0.2% proof stress was 174 MPa and the elongation was 21%. From the results, it was confirmed that the die cast aluminum alloy material obtained from the aluminum alloy for die casting of the present invention has a high strength of 170 MPa or more and an elongation of more than 20%, and can be suitably used for, for example, vehicle members.

Example 4

After melting the aluminum alloy having the composition shown in TABLE 4, a die cast aluminum alloy material was obtained by the same die casting as in Example 3. The values in TABLE 4 are % by mass, which are the measurement results of the emission spectroscopic analysis.

TABLE 4

| | Cu | Si | Mg | Zn | Fe | Mn | Cr | Ti | P | Be | Al |
|---|---|---|---|---|---|---|---|---|---|---|---|
| Ex. 4 | <0.01 | 0.04 | 4.01 | <0.01 | 0.06 | 1.6 | — | — | — | 0.003 | Bal. |

When the No. 14B test piece specified in JIS-Z2241 was sampled from the obtained die cast aluminum alloy material and subjected to the tensile test at room temperature, the 0.2% proof stress was 140 MPa and the elongation was 14%.

Example 5

After melting the aluminum alloy having the composition shown in TABLE 5, a die cast aluminum alloy material was obtained by the same die casting as in Example 3. The values in TABLE 5 are % by mass, which are the measurement results of the emission spectroscopic analysis.

TABLE 5

| | Cu | Si | Mg | Zn | Fe | Mn | Cr | Ti | P | Be | Al |
|---|---|---|---|---|---|---|---|---|---|---|---|
| Ex. 5 | <0.01 | 0.05 | 5.00 | <0.01 | 0.06 | 1.5 | — | — | — | 0.003 | Bal. |

When the No. 14B test piece specified in JIS-Z2241 was sampled from the obtained die cast aluminum alloy material and subjected to the tensile test at room temperature, the 0.2% proof stress was 152 MPa and the elongation was 12%.

Example 6

After melting the aluminum alloy having the composition shown in TABLE 6, a die cast aluminum alloy material was obtained by the same die casting as in Example 3. The values in TABLE 6 are % by mass, which are the measurement results of the emission spectroscopic analysis.

TABLE 6

| | Cu | Si | Mg | Zn | Fe | Mn | Cr | Ti | P | Be | Al |
|---|---|---|---|---|---|---|---|---|---|---|---|
| Ex. 6 | <0.01 | 0.05 | 5.90 | <0.01 | 0.05 | 1.05 | — | — | — | 0.004 | Bal. |

When the No. 14B test piece specified in JIS-Z2241 was sampled from the obtained die cast aluminum alloy material and subjected to the tensile test at room temperature, the 0.2% proof stress was 155 MPa and the elongation was 13%.

Comparative Example 1

A Lansley test piece was obtained in the same manner as in Example 1 except that the melting material was prepared so as to have the components described as Comparative Example 1 in TABLE 1. The composition of the Lansley test piece was measured in the same manner as in Example 1, and the obtained results are shown in TABLE 1.

Further, when the size of the primary crystal Al—Mn-based compound was measured in the same manner as in Example 1, the maximum size was 62 μm. An optical micrograph is shown in FIG. 3.

Furthermore, the tensile test was performed in the same manner as in Example 1, and the obtained results are shown in TABLE 2. Although the 0.2% proof stress shows a high value, there are cases where the elongation is less than 10%.

Comparative Example 2

A Lansley test piece was obtained in the same manner as in Example 1 except that the melting material was prepared so as to have the components described as Comparative Example 2 in TABLE 1. The composition of the Lansley test piece was measured in the same manner as in Example 1, and the obtained results are shown in TABLE 1.

Further, when the size of the primary crystal Al—Mn-based compound was measured in the same manner as in Example 1, the maximum size was 254 μm. An optical micrograph is shown in FIG. 4.

Furthermore, the tensile test was performed in the same manner as in Example 1, and the obtained results are shown in TABLE 2. Although the 0.2% proof stress shows a high value, the elongation is less than 10% in all the test pieces. It is considered that the elongation was remarkably reduced due to the coarsening of the primary crystal Al—Mn-based compound.

Comparative Example 3

After melting the aluminum alloy having the composition shown in TABLE 7, a die cast aluminum alloy material was obtained by the same die casting as in Example 3. The values in TABLE 7 are % by mass, which are the measurement results of the emission spectroscopic analysis.

TABLE 7

| | Cu | Si | Mg | Zn | Fe | Mn | Cr | Ti | P | Be | Al |
|---|---|---|---|---|---|---|---|---|---|---|---|
| Com. Ex. 3 | <0.01 | 0.04 | 3.05 | <0.01 | 0.06 | 1.60 | — | — | — | 0.003 | Bal. |

When the No. 14B test piece specified in JIS-Z2241 was sampled from the obtained die cast aluminum alloy material and subjected to the tensile test at room temperature, the 0.2% proof stress was 126 MPa and the elongation was 19%.

Comparative Example 4

After melting the aluminum alloy having the composition shown in TABLE 8, a die cast aluminum alloy material was obtained by the same die casting as in Example 3. The values in TABLE 8 are % by mass, which are the measurement results of the emission spectroscopic analysis.

TABLE 8

| | Cu | Si | Mg | Zn | Fe | Mn | Cr | Ti | P | Be | Al |
|---|---|---|---|---|---|---|---|---|---|---|---|
| Com. Ex. 4 | <0.01 | 0.05 | 5.80 | <0.01 | 0.05 | 0.54 | — | — | — | 0.004 | Bal. |

When the No. 14B test piece specified in JIS-Z2241 was sampled from the obtained die cast aluminum alloy material and subjected to the tensile test at room temperature, the 0.2% proof stress was 137 MPa and the elongation was 15%.

Comparative Example 5

After melting the aluminum alloy having the composition shown in TABLE 9, a die cast aluminum alloy material was obtained by the same die casting as in Example 3. The values in TABLE 9 are % by mass, which are the measurement results of the emission spectroscopic analysis.

TABLE 9

| | Cu | Si | Mg | Zn | Fe | Mn | Cr | Ti | P | Be | Al |
|---|---|---|---|---|---|---|---|---|---|---|---|
| Com. Ex. 5 | <0.01 | 0.05 | 5.70 | <0.01 | 0.05 | 1.90 | — | — | — | 0.003 | Bal. |

When the No. 14B test piece specified in JIS-Z2241 was sampled from the obtained die cast aluminum alloy material and subjected to the tensile test at room temperature, the 0.2% proof stress was 137 MPa and the elongation was 15%.

From the above results, when the Mg content is 3.7 to 9.0% by mass and the Mn content is 0.8 to 1.7% by mass, the 0.2% proof stress of 140 MPa or more and the elongation of 11% or more can be obtained. Further, when the Mg content is 4.7 to 9.0% by mass and the Mn content is 0.9 to 1.7% by mass, the 0.2% proof stress of 150 MPa or more and the elongation of 12% or more can be obtained. Furthermore, when the Mg content is 5.2 to 6.5% by mass and the Mn content is 1.2 to 1.7% by mass, the 0.2% proof stress of 160 MPa or more and the elongation of 15% or more can be obtained.

The invention claimed is:

1. A die cast aluminum alloy material made of an aluminum alloy for die casting, the aluminum alloy comprising Mg: 4.7 to 9.0% by mass, Mn: 0.9 to 1.7% by mass and Zn: 1.0% by mass or less, with the balance being Al and unavoidable impurities, wherein the maximum particle size in a longitudinal direction of a primary crystal Al—Mn-based compound in the die cast aluminum alloy material is 150 μm or less.

2. The die cast aluminum alloy material according to claim 1, wherein the Mg content is 5.2 to 6.5% by mass, and the Mn content is 1.2 to 1.7% by mass.

3. The die cast aluminum alloy material according to claim 1, wherein the Si content in the unavoidable impurities is regulated to 0.3% by mass or less.

4. The die cast aluminum alloy material according to claim 1, wherein the Fe content in the unavoidable impurities is regulated to 0.4% by mass or less.

5. The die cast aluminum alloy material according to claim 1, further comprising Ti: 0.001 to 1.0% by mass and/or B: 0.0001 to 0.1% by mass as an optional additive element.

6. The die cast aluminum alloy material according to claim 1, which has a tensile property of 0.2% proof stress of 140 MPa or more and elongation of 11% or more.

7. A die cast aluminum alloy material made of an aluminum alloy for die casting, the aluminum alloy comprising Mg: 4.7 to 9.0% by mass and Mn: 0.9 to 1.7% by mass, with the balance being Al and unavoidable impurities, wherein the die cast aluminum alloy material has a tensile property of 0.2% proof stress of 140 MPa or more and elongation of 11% or more, and the maximum particle size in a longitudinal direction of a primary crystal Al—Mn-based compound in the die cast aluminum alloy material is 150 μm or less.

* * * * *